United States Patent [19]

Macek

[11] Patent Number: 4,583,743

[45] Date of Patent: Apr. 22, 1986

[54] PROJECTILE CATAPULT AND AMUSEMENT DEVICE

[76] Inventor: George L. Macek, 10519 Brosius Rd., Garrettsville, Ohio 44231

[21] Appl. No.: 735,097

[22] Filed: May 17, 1985

[51] Int. Cl.[4] ..... A63F 9/02; F41J 9/02; F41B 3/02

[52] U.S. Cl. ..... 273/368; 124/4; 124/79; 273/343

[58] Field of Search ..... 124/4, 79; 273/343, 273/350, 366–368, 399, 353, 355, 356

[56] References Cited

U.S. PATENT DOCUMENTS

| | | | |
|---|---|---|---|
| 310,388 | 1/1885 | Dealy | 124/4 X |
| 939,580 | 11/1909 | Young | 273/368 X |
| 1,091,339 | 3/1914 | Howarth | 273/350 |
| 1,341,185 | 5/1920 | Lowman | 124/4 |
| 1,348,283 | 8/1920 | Koehl | 273/368 |
| 1,563,908 | 12/1925 | Krause | 124/4 X |
| 2,146,156 | 2/1939 | Nicot et al. | 124/4 |
| 2,827,034 | 3/1958 | Rothe | 124/79 |
| 3,003,767 | 10/1961 | Keuls | 124/79 X |
| 3,208,444 | 9/1965 | Sipos | 124/4 |

FOREIGN PATENT DOCUMENTS

| | | | |
|---|---|---|---|
| 1075 | of 1912 | United Kingdom | 124/4 |
| 1249216 | 10/1971 | United Kingdom | 273/353 |

*Primary Examiner*—Paul E. Shapiro
*Attorney, Agent, or Firm*—Mack D. Cook, II

[57] ABSTRACT

A projectile catapult which is inherently energy dissipative or mechanically not efficient for "jumping" a simulated frog from the edge of a simulated lake or pond toward a moving lily pad target. The catapult is actuated by user-provided force but use thereof with game apparatus as an amusement device is determined not by user strength but rather by factors of chance and user skill.

2 Claims, 4 Drawing Figures

PROJECTILE CATAPULT AND AMUSEMENT DEVICE

BACKGROUND OF THE INVENTION

The present invention relates to a projectile catapult and game apparatus for use as an amusement device. The projectile is a simulated frog, a draping aerial projectile. The frog is propelled by the catapult, actuated by user-provided force. The frog is aimed by the catapult user at a lily pad target, an upwardly facing projectile catch or bounce surface moving along an endless circular path in a tank of water simulating a lake or pond.

Relevant classifications for prior art patents appear to be: Class 273/subclass 343 for the frog; Class 124/subclass 79 for the catapult; and, Class 273/subclasses 342, 366 and 368 for the lily pads.

SUMMARY OF THE INVENTION

It is an object of the invention to provide an improved amusement device or game comprising a frog projectile and a catapult aimed and actuated by the game player at a moving lily pad target; a game both of chance and skill.

It is a further object to provide a game for many players at the same time, which is safe for the players and spectators, and which is portable and movable from location to location.

Still further, it is an object to provide a projectile catapult which is inherently energy dissipative or mechanically not efficient so that the frog can be made to "jump" on to a lily pad by little or frail persons or by big strong men.

These and other objects of the invention and the advantages thereof will become apparent in view of the drawings and the detailed description.

In general, an amusement device according to the invention includes a projectile catapult, a table and a series of adjacent targets. The projectile catault has a base. Forward and rearward stanchions are connected to the base and mount front and rear pivot pins. The front pivot pin is at a height above the rear pivot pin. An elongate power arm is mounted on the front pivot pin and projects toward the rearward stanchion. A projectile platform is carried on and above the power arm. An elongate rocker arm is mounted on the rear pivot pin and has a forward portion projecting beneath the power arm and a rearward portion projecting behind the rearward stanchion. There is a forward resilient force transmission means between the power arm and the rocker arm. There is also a rearward resilient force transmission means on the rocker arm behind the rear stanchion.

The catapult base also has a set of swivel wheels for rolling on the table. The swivel wheels and confined on the table, with a limited range of movement, by a rail frame connected to the table.

The catapult base is moved by the user on the swivel wheels for aiming the projectile platform at a selected target by a pair of grip handles projecting above the rearward end of the base.

IN THE DRAWINGS

DETAILED DESCRIPTION OF THE INVENTION

Figure 1:
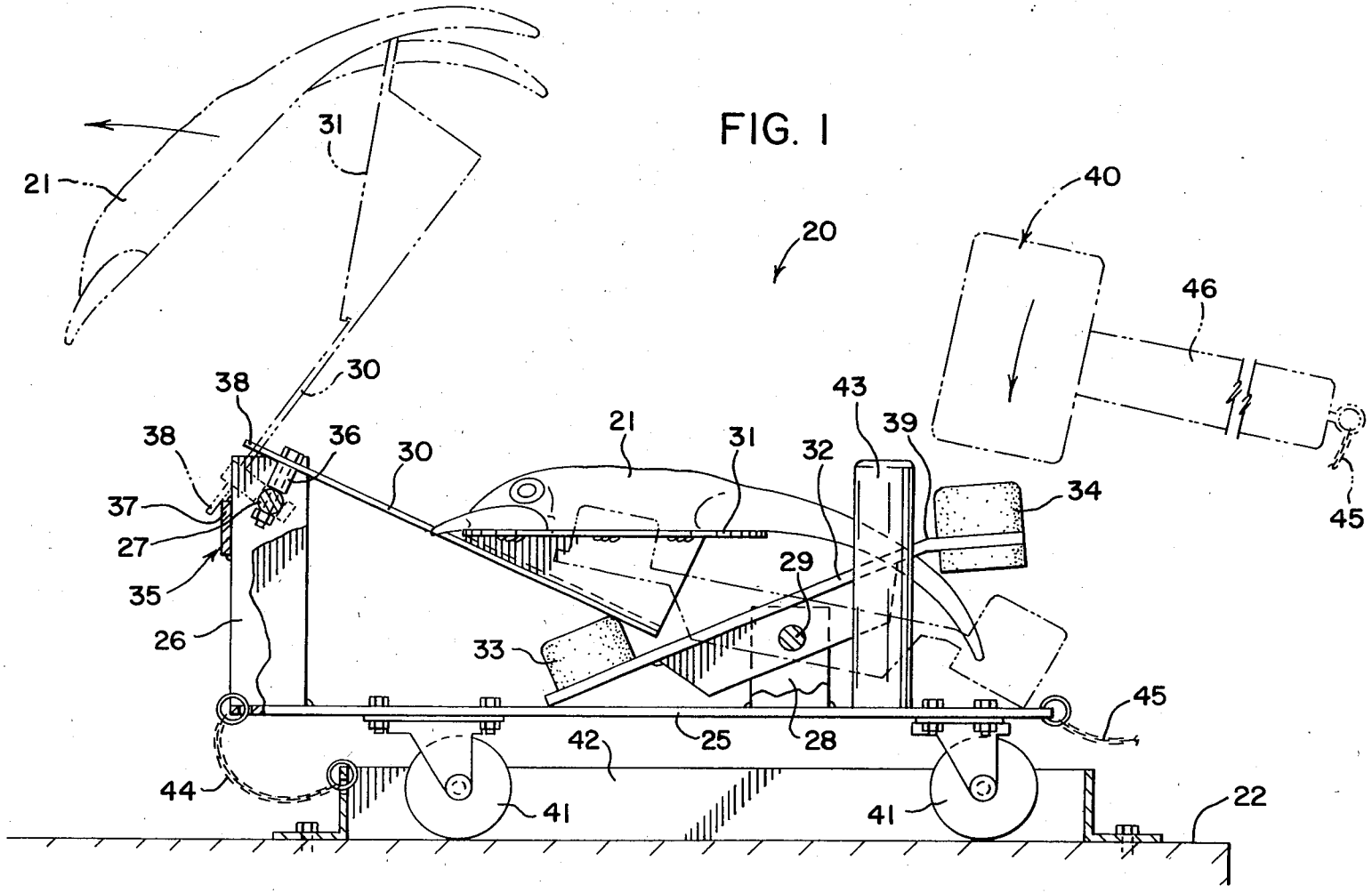
FIG. 1 is a side view of a projectile catapult according to the invention.
Figure 2:
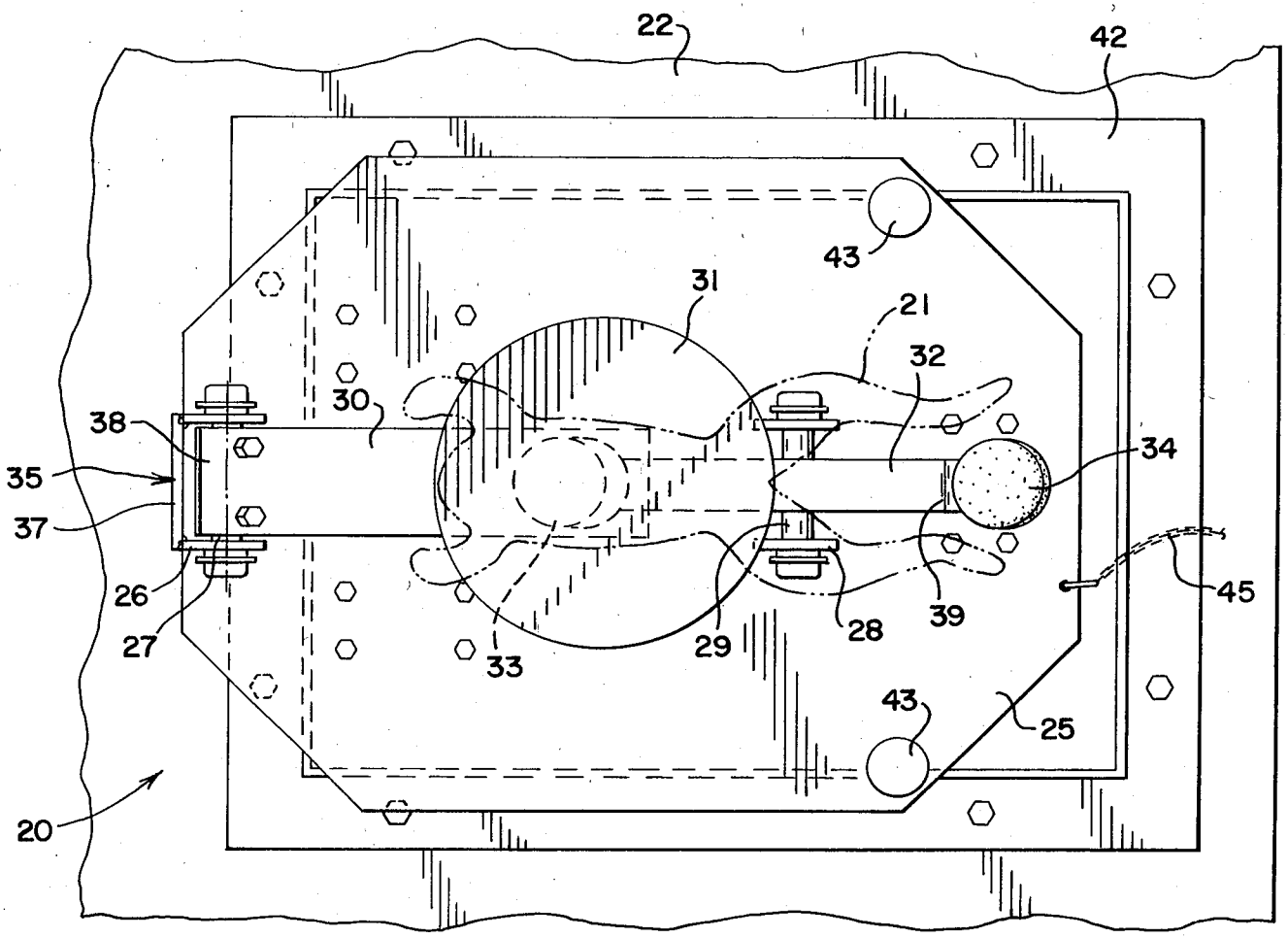
FIG. 2 is a top plan view of of the projectile catapult.
Figure 3:
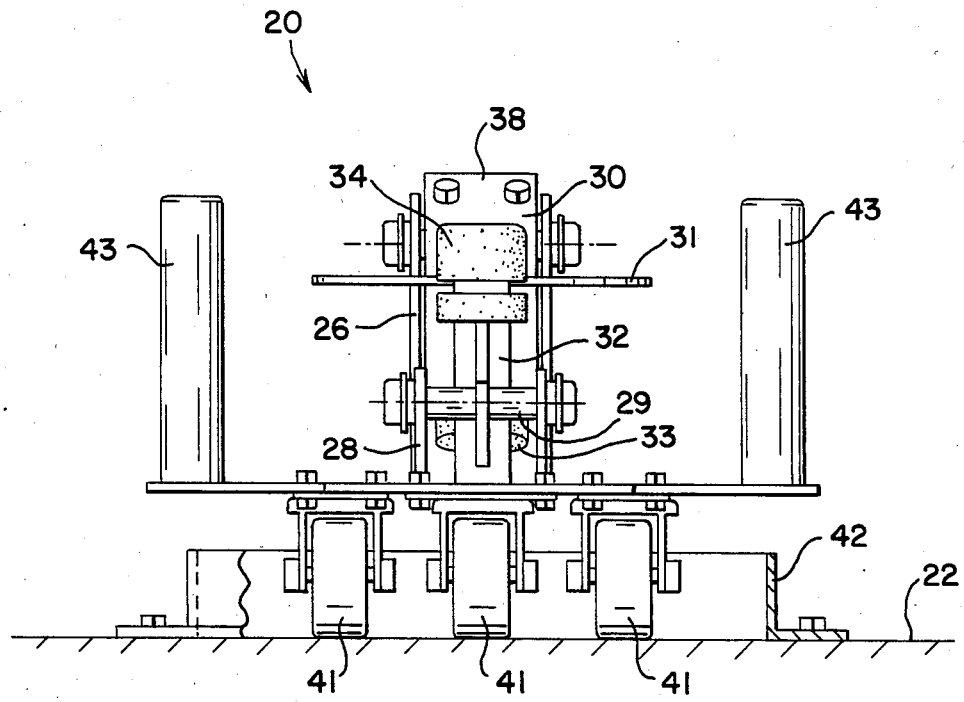
FIG. 3 is a rear view of the projectile catapult.

A projectile catapult is referred to generally by the numeral 20. The projectile 21 may be a simulated "jumping bull frog" molded from a suitable non-rigid elastomer or plastic. The catapult 20 moves on the surface of a table 22 positioned a few feet away from a water filled tank 23 with a series of slowly revolving lily pad targets 24.

The catapult 20 has a base 25. The front of the base 25 has a vertically extending forward stanchion 26. The forward stanchion 26 mounts a horizontal front pivot pin 27 at a height X, eg. 4.25 inches, above the base 25. The base 25 also has a vertically extending rearward stanchion 28. The rearward stanchion 28 mounts a horizontal pivot pin 29 at a height less than X/2, eg. 1.375 inches, above the base 25.

The catapult 20 also has an arm elongate power arm 30. The power arm 30 has a forward portion mounted by the front pivot pin 27 and a rearward portion projecting toward the rearward stanchion 28.

A platform 31 for a frog projectile 21, is carried on the rearward portion of the power arm 30. As shown, in the normal or static condition the platform 31 is substantially horizontal and at a height less than X, eg. 3.5 inches, above the base 25.

The catapult 20 further has an elongate rocker arm 32. The rocker arm 32 has a center portion mounted by the rear pivot pin 29. The forward portion of the rocker arm 32 projects below the rearward portion of the power arm 30. The rearward portion of the rocker arm 32 projects behing the rearward stanchion 28.

A forward resilient force transmission means 33 is carried on and above the forward portion of the rocker arm 32. A similar means 34 is carried on, above and below the rearward portion of the rocker arm 32. The force transmission means 32 and 33 have the inherent properties of energy absorbtion and dimensional stability.

The catapult 20 further has a stop means indicated at 35 and positioned adjacent the front pivot pin 27. The function of the stop means 35 is to limit arcuate movement of the projectile platform 31 to substantially 90 degrees or less when user-provided impact force is applied to the rearward resilient force transmission means 34 and transmitted to the power arm 30 through the forward resilient force transmission means 33.

The forward portion of the power arm 30 may be connected to the front pin 27 by a pair of spacer studs 36 having a threaded shank (not shown) extending through suitable cross bores (also, not shown) in the pivot pin 27. The stop means 35 may be a lateral web 37 carried on the forward stanchion 26 and positioned to engage a projecting front end 38 of the power arm 30.

The rearward portion of the rocker arm 32 may be normally angled, as at 39, toward horizontal so that the upper face of the rearward resilient force transmission means 34 is substantially horizontal in the static condition. This position affords the user a better opportunity to make full surface contact of the force transmission means 34 with a suitable mallet, indicated at 40, having an energy dissipative head.

The under surface of the catapult base 25 may be provided with a set of three swivel wheels 41 rolling on the table 22. As shown, there are two forward wheels 41 and one rearward wheel 41. The wheels 41 are confined on the table 22, with a limited range of movement, by a generally rectangular rail frame indicated at 42 connected to the table. The base 25 may be moved by the user on the wheels 41 within the rail frame 42 for aiming the projectile 21 by a pair of grip handles 43 projecting above the rearward end of the base. The base 25 is also preferably loosely connected to the table 22 as by a chain 44 extending between the rail 42 to the forward end of the base 25. The mallet 40 is similarly loosely connected to the table 22 as by a chain 45 extending between the rearward end of the base 25 and the mallet handle 46.

Figure 4:
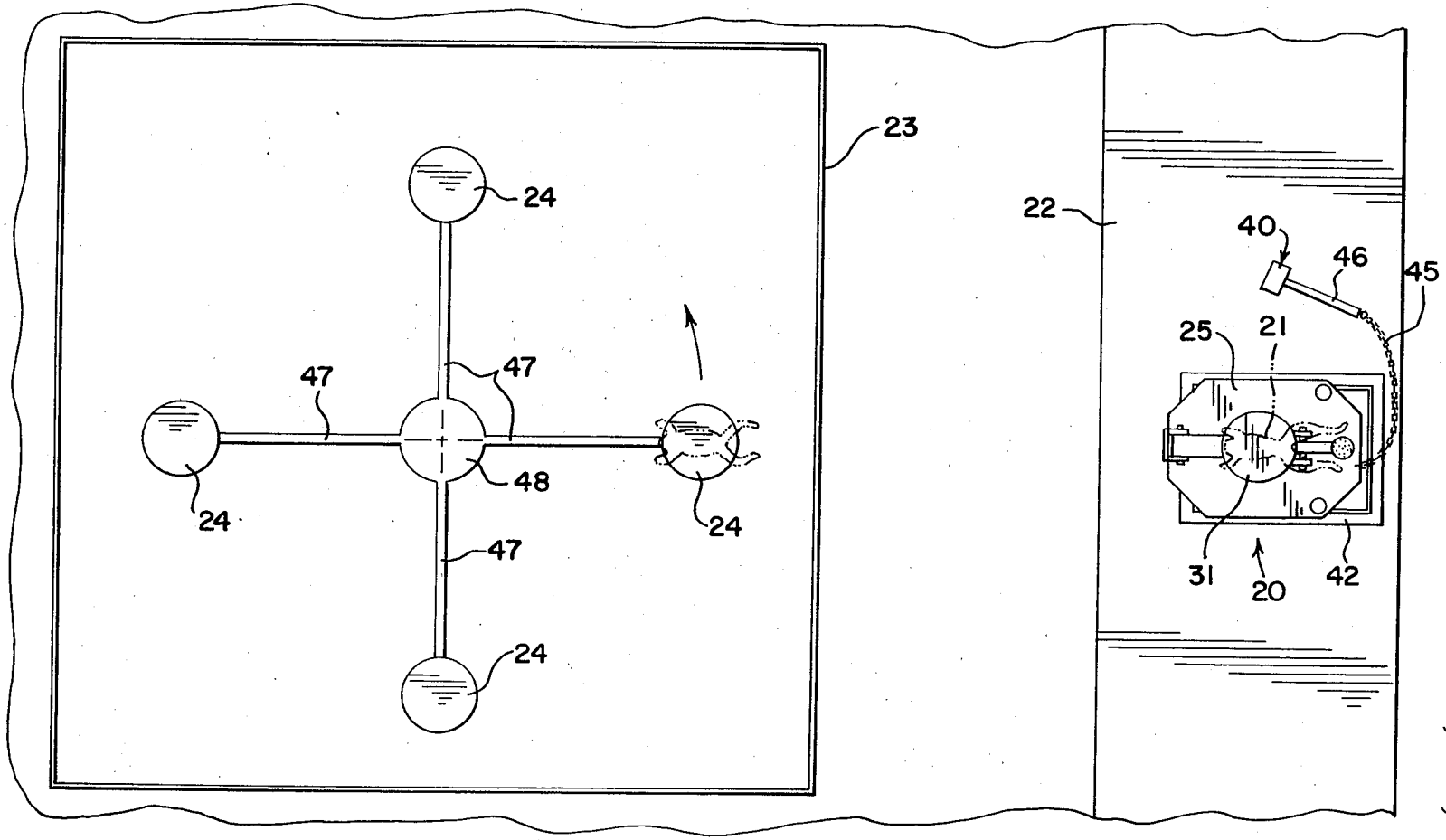
FIG. 4 is a plan view of the water tank and the lily pad targets for a frog propelled from the projectile platform of the catapult.

Referring to FIG. 4, the lily pad target 24 may be carried on the ends of a series of equally spaced support arms 47 extending radially of a hub member 48. The hub member 48 is slowly rotated by a suitable drive mechanism (not shown) mounted beneath the tank 23.

What is claimed is:

1. An amusement device including a projectile catapult, a table and a series of adjacent targets:

said projectile catapult having a base, forward and rearward stanchions connected to said base and mounting front and rear pivot pins, said front pivot pin being at a height above said rear pivot pin, an elongate power arm mounted on said front pivot pin and projecting toward said rearward stanchion, a projectile platform carried on and above said power arm, an elongate rocker arm mounted on said rear pivot pin and having a forward portion projecting beneath said power arm and a rearward portion projecting behind said rearward stanchion, a forward resilient force transmission means between said power arm and said rocker arm, and, a rearward resilient force transmission means on said rocker arm behind said rear stanchion;

said catapult base further having a set of swivel wheels for rolling on said table and confined on said table, with a limited range of movement, by a rail frame connected to said table;

said catapult base being moved by the user on said swivel wheels for aiming said projectile platform at a selected target by a pair of grip handles projecting above the rearward end of said base.

2. An amusement device using the catapult of claim 1 wherein the projectile is a simulated frog, a draping aerial projectile, selectively aimed by the catapult user at a lily pad target, an upwardly facing projectile catch or bounce surface moving along an endless path in a tank of water simulating a lake or pond.

* * * * *